US007066002B2

(12) United States Patent
Price et al.

(10) Patent No.: US 7,066,002 B2
(45) Date of Patent: Jun. 27, 2006

(54) METAL SHEET PUNCH DEVICE

(76) Inventors: John Price, 2162 E. Lake Dr., Union, NE (US) 68455; Leighton Schafer, 310 First St., Dubois, NE (US) 68345

( * ) Notice: Subject to any disclaimer, the term of this patent is extended or adjusted under 35 U.S.C. 154(b) by 280 days.

(21) Appl. No.: 10/799,268

(22) Filed: Mar. 12, 2004

(65) Prior Publication Data

US 2005/0199034 A1 Sep. 15, 2005

(51) Int. Cl.
*B21D 17/02* (2006.01)
*B21D 31/02* (2006.01)

(52) U.S. Cl. ..... 72/450; 72/325; 72/472; 72/479; 29/243.5; 83/307; 83/310; 83/634

(58) Field of Classification Search ..... 72/325, 72/450, 451, 472, 479; 29/243.5, 521; 83/307, 83/310, 634
See application file for complete search history.

(56) References Cited

U.S. PATENT DOCUMENTS 3,910,093 A * 10/1975 Maloney et al. ..... 72/451
3,925,875 A * 12/1975 Doke ..... 72/325
4,442,581 A * 4/1984 Molnick ..... 29/243.5
4,559,805 A * 12/1985 McClure ..... 72/479
4,621,511 A * 11/1986 Knudson ..... 72/186
2004/0093925 A1* 5/2004 Bodwell ..... 72/325

* cited by examiner

*Primary Examiner*—David Jones
(74) *Attorney, Agent, or Firm*—Adam H. Jacobs

(57) ABSTRACT

A metal sheet punch device for metal sheets which includes a longitudinally extended frame having forward and rearward ends and alignment devices for aligning the frame on a metal sheet. At least two metal punch devices are mounted on the frame, each including a metal punch support structure movably mounted on the frame and a metal punch having a pointed lower end, the metal punch mounted on the underside of the metal punch support arm structure. A support structure drive device such as a coiled spring is operatively connected to the metal punch support structure to rapidly move the metal punch support structure between a retracted position and an extended position and a trigger device is operatively connected to the metal punch devices to trigger each of them to drive the metal punch into the metal sheet to form at least two securement screw indentations therein.

19 Claims, 7 Drawing Sheets

METAL SHEET PUNCH DEVICE

BACKGROUND OF THE INVENTION

1. Technical Field

The present invention relates to punch devices and, more particularly, to a metal sheet punch device having a longitudinally extended frame having forward and rearward ends, an alignment device mounted on the frame for aligning the frame on a metal roof, at least two metal punch devices mounted on the frame, each device including a metal punch support arm structure movably mounted on the frame, a generally pointed metal punch mounted on the underside of the metal punch support arm structure, and a support arm structure drive device mounted on the frame which is operatively connected to the metal punch support arm structure to move the metal punch support arm structure between a retracted position and an extended position, and a trigger device operatively connected to each of the metal punch devices to trigger the metal punch devices to punch securement screw indentations in the metal roof.

2. Description of the Prior Art

Metal sheeting for roofs, ceilings and walls are used on many different types of buildings, including both commercial and residential structures. Of these, the metal roof is the most common use of metal sheeting, and the standard metal roof would include a wooden or metal roof frame consisting of a plurality of spaced beams, usually referred to as "nailers" or "purling", extending between and connecting the upper sections of the walls of the building. Mounted on this framework are a plurality of metal roof sections, which generally have widths of between three and four feet (3' to 4' with the usual width being approximately 38") and have lengths of six feet up to forty feet (6' to 40') depending on the intended use of the sheet. The metal sheet sections also are usually "corrugated" to include alternating raised and lowered sections of the roof section for increased structural stability. Once the metal roof section is placed on the underlying roof framework, the metal roof section is affixed to the roof framework by a plurality of screws or other such fasteners which extend downwards through the metal roof section into the framework underneath the metal roof section. The next section of the metal roof is then partially overlapped with the metal roof section affixed to the roof frame, and the process is continued until the metal roof is erected.

While the preceding description of the erection of the metal roof sounds relatively simple, in practice the erection of a metal roof is anything but simple. In fact, two main problems occur with virtually every metal roof erection, the first being that once the metal roof section is placed on the roof frame, the position of each beam must be estimated beneath the metal roof section to permit proper connection of the metal roof section to the roof frame. Second, the positioning and insertion of each of the fastening screws through the metal roof section should be in an alignment pattern which not only secures the metal roof section to the roof frame, but also is aesthetically pleasing to enhance both the functionality and appearance of the metal roof once it is erected. There is therefore a need for a relatively simple and efficient device which will properly align and space the screws being used to secure the metal roof section to the roof frame.

In the prior art, alignment of the securement screw indentations was generally performed by formation of a chalk line on the metal roof section. Specifically, a roof installer would extend a chalk line from one end of the metal roof section being installed to the opposite end thereof with the chalk line aligned above the metal roof section with the roof support beam positioned underneath the metal roof section such that when the chalk line was "snapped," the resulting chalk line would be aligned generally parallel with the underlying roof beam. The roof installer would then proceed along the chalk line marking at generally equal distances the locations for the series of securement screw indentations to be formed in the metal roof section. Once the locations of the securement screw indentations were determined along the chalk line, the roof installer would then proceed to form the indentations with a metal punch and hammer, forming each of the indentations one at a time along the chalk line, or alternatively may even use only a self-tapping screw to pierce the metal sheet. Finally, the roof installer would return to each of the securement screw indentations and insert the securement screw into the indentation to secure the metal roof section to the underlying roof support beam. Although years of practice may increase the speed with which the above-described method is performed, it is abundantly clear that this procedure is time-consuming and fraught with opportunities for error and therefore there is a need for an improved system and device by which a plurality of securement screw indentations may be formed in the metal roof section in an accurate and efficient manner.

There are some devices found in the prior art which, when used in connection with some types of formed sheet metal such as gutters and the like, will form a punch hole in the metal. These single-punch devices have been in existence and have been used with metal gutters, but the modifications necessary to permit use of these devices with metal sheets often would render the devices inoperable for their original intended purpose. Furthermore, although these devices, if modified, could conceivably provide alignment for a single screw to be placed through a metal roof section into the underlying frame, they still will not solve the problem of the alignment of multiple screws and the spacing thereof to enhance the functionality and appearance of the series of screws. There is therefore a need for a multiple punch device which will not only provide alignment of the screw holes with the underlying roof frame, but will also space the screws in their preferred securement spacing to ensure both improved functionality and improved aesthetic appearance.

There is therefore a need for an improved metal sheet punch device.

Another object of the present invention is to provide a metal sheet punch device which includes a longitudinally extended frame having alignment devices mounted thereon to properly align the metal frame on the metal roof and at least two metal punch devices mounted on the frame for forming at least two indentations in the metal roof into which fastening screws may be quickly and easily inserted.

Another object of the present invention is to provide a metal sheet punch device in which the metal punch devices include a metal punch support arm structure movably mounted on the frame, a generally pointed metal punch having a pointed lower end mounted on the underside of the metal punch support arm structure, and a support arm structure drive device such as a spring or pneumatic jack which is operatively connected to the metal punch support arm structure to move the metal punch support arm structure between a retracted position and an extended position to drive the metal punch into the metal roof section.

Another object of the present invention is to provide a metal sheet punch device which will quickly and easily form multiple securement screw indentations in a metal roof section, the indentations being properly spaced from one another and generally accurately aligned with the underlying roof beam to which the metal roof section is to be affixed.

Another object of the present invention is to provide a metal sheet punch device which can be quickly and easily used to form the securement screw indentations, yet which does not necessarily require connection to an external power source, thus preventing wire entanglements and the necessity for hose connections required by other devices found in the prior art.

Finally, an object of the present invention is to provide a metal sheet punch device which is relatively simple and economical in construction and is safe, efficient, and accurate in use.

SUMMARY OF THE INVENTION

The present invention provides a metal sheet punch device for metal roofs which includes a longitudinally extended frame having forward and rearward ends and alignment devices mounted on the frame adjacent the forward and rearward ends for aligning the frame on a metal roof. At least two metal punch devices are mounted on the frame, each of the metal punch devices including a metal punch support arm structure movably mounted on the frame, the metal punch support arm structure movable between a retracted position and an extended position relative to the frame, and a generally pointed metal punch having a pointed lower end, the generally conical metal punch mounted on the underside of the metal punch support arm structure. A support arm structure drive device such as a coiled spring or pneumatic jack is mounted on the frame and operatively connected to the metal punch support arm structure to rapidly move the metal punch support arm structure between the retracted position and the extended position. Finally, a trigger device is operatively connected to the metal punch devices, the trigger device operative to trigger each of the support arm structure drive devices operatively connected to each of the metal punch devices to drive the metal punch support arm structures from the retracted position to the extended position such that the metal punches engage the metal roof positioned there underneath to generally simultaneously form at least two spaced-apart indentations in the metal roof by impact of the metal punches with the metal roof, the indentations then being used for the insertion and alignment of securement screws to secure the metal roof section on the underlying roof support frame.

The metal sheet punch device as thus described is far superior to those devices found in the prior art. Specifically, the ability of the present device to perform simultaneous multiple punches which are accurately aligned with the underlying roof frame greatly decreases the amount of time needed to align and lay out the punched indentations required when using the methods of the prior art, such as chalk lining or the like. Furthermore, because the present invention, when outfitted with coiled springs, is independent of any power source, it is much easier and safer for a roof installer to use than many other electrical or pneumatic devices used in construction. Also, because of the forward and rearward alignment devices mounted on the longitudinally extended frame, it is difficult for a user of the present invention to incorrectly use and align the invention, thus greatly reducing the opportunity for mistakes and increasing the efficiency with which the metal roof is assembled. Finally, because the metal sheet punch device of the present invention is generally intuitive in use, it does not take a great deal of training to learn to use the present invention, meaning that virtually any worker from the most skilled to the least skilled may use the present invention to properly and quickly produce securement screw indentations in the metal roof sections. It is thus seen that the present invention provides a substantial improvement over those roof punch devices found in the prior art.

DESCRIPTION OF THE PREFERRED EMBODIMENT

Figure 1:
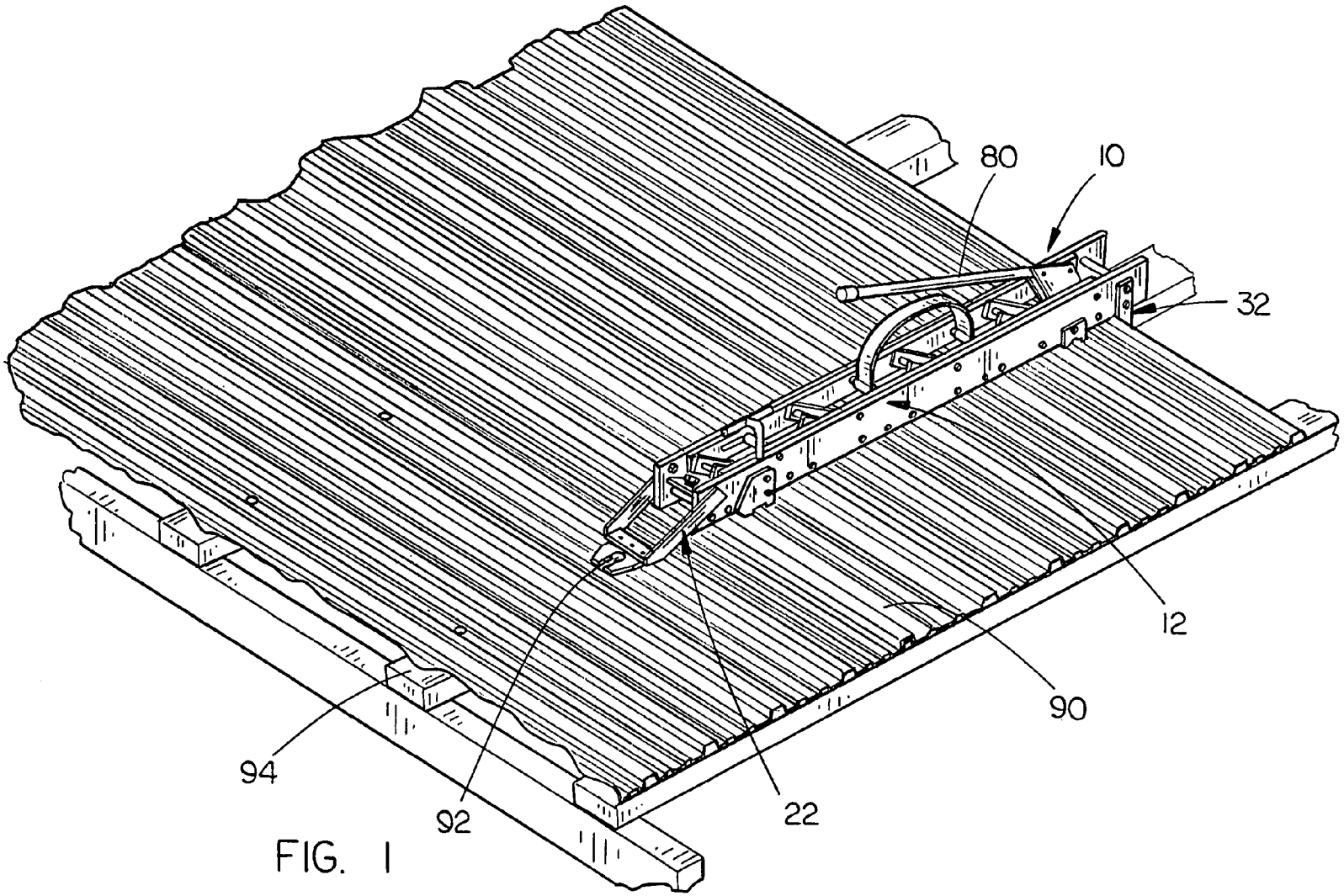
FIG. 1 is a perspective view of the metal sheet punch device of the present invention being used on a metal roof.

The metal sheet punch device 10 of the present invention is shown best in FIGS. 1–4 as including a longitudinally extended frame 12 having a forward end 14 and rearward end 16 and a plurality of metal punch devices 50*a*, 50*b*, 50*c*, and 50*d* which are movably mounted on the frame 12. In the preferred embodiment, the longitudinally extended frame 12 is constructed as including a pair of generally parallel frame plates 18*a* and 18*b* which are constructed of a durable material such as metal, aluminum or hardened plastic and would have a length of approximately 36 to 60 inches, a vertical height of approximately 1 to 6 inches, and would be spaced from one another approximately 1 to 6 inches, the frame plates 18*a* and 18*b* being supported apart from and connected to one another by a plurality of spacer rods 20. It is further preferred that each of the elements of the present invention be constructed of rigid and durable materials, and therefore it is expected that the metal sheet punch device 10 will be constructed of metal such as steel or aluminum or a hardened plastic material, depending on the intended functionality of the element being constructed.

Figure 2:
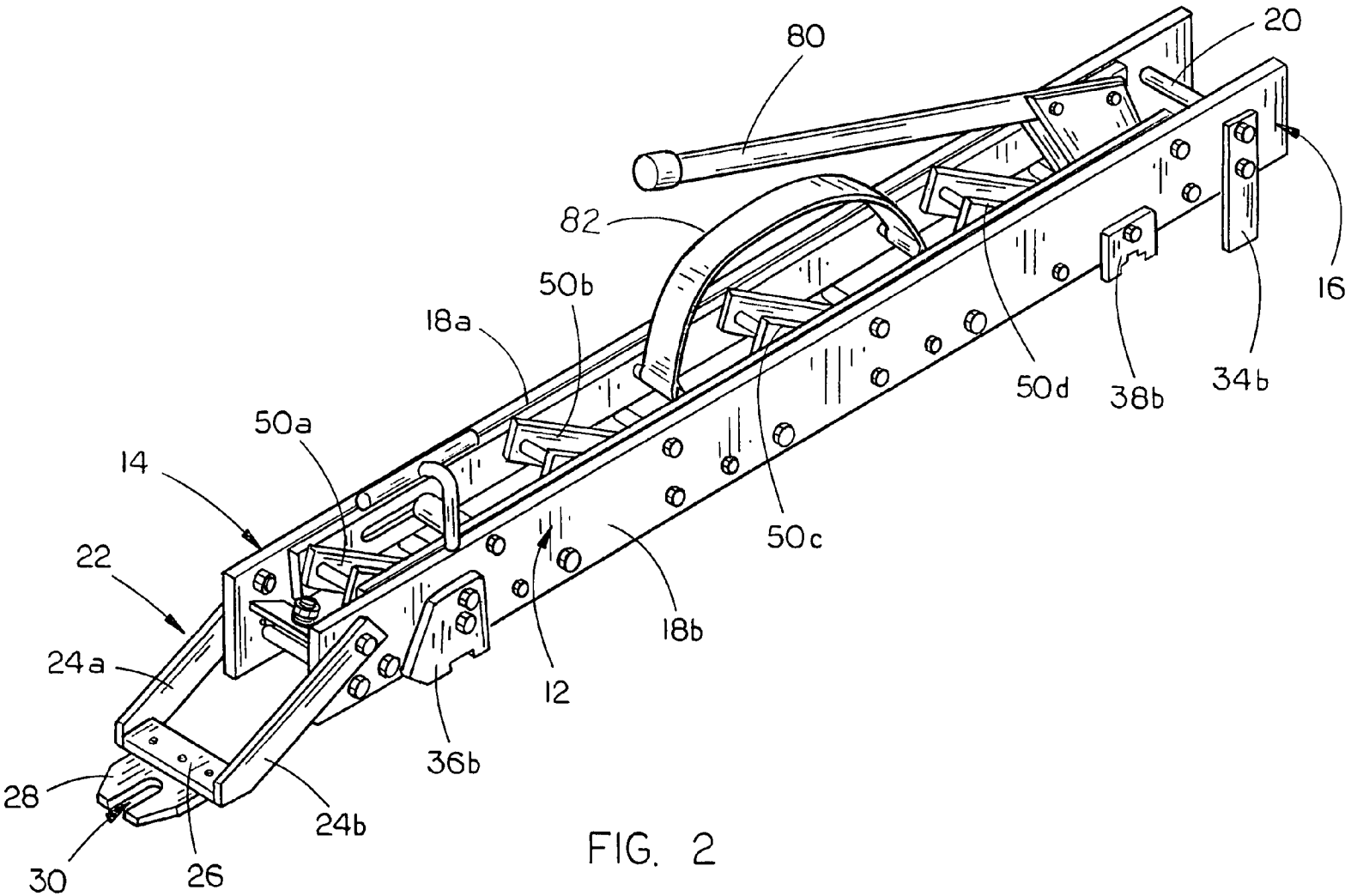
FIG. 2 is a perspective view of the metal sheet punch device of the present invention.
Figure 3:
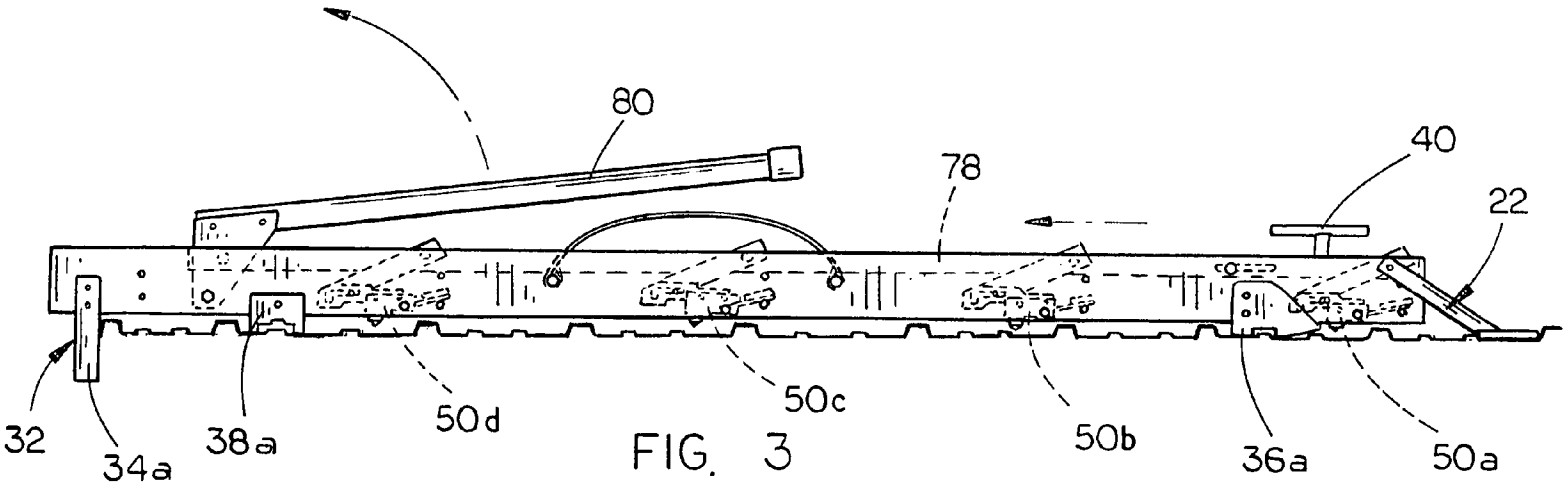
FIG. 3 is a detailed side elevational view of the present invention during the "cocking" phase of use.
Figure 4:
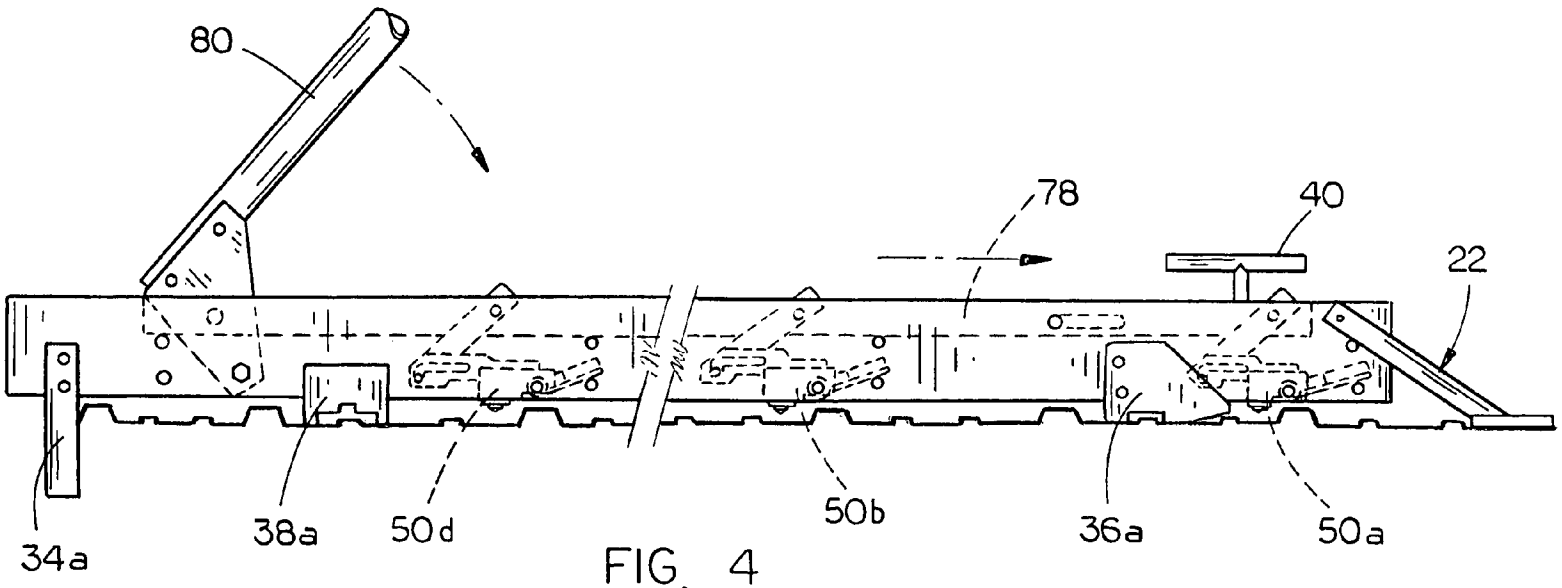
FIG. 4 is a detailed side elevational view of the present invention immediately prior to triggering of the metal punches.

Mounted on and extending forwards from forward end 14 of frame 12 is forward alignment device 22 which, in the preferred embodiment, would include a pair of mounting arms 24*a* and 24*b* extending forwards from the frame 12 and an alignment plate mounting bar 26 which extends between and connects the forward ends of mounting arms 24*a* and 24*b*, as shown best in FIG. 2. Mounting on and extending forwards from alignment plate mounting bar 26 is the alignment plate 28 which, in the preferred embodiment, would be a generally rectangular or trapezoidal plate extending generally horizontally from the alignment plate mounting board 28 and would further include a generally U-shaped screw engagement slot 30 formed in the forward end of alignment plate 28 and extending rearwards towards frame 12 as shown best in FIG. 2. The screw engagement slot 30 is designed to fit over and engage a securement screw 92 which has already been mounted on the metal roof section 90 as shown best in FIG. 1. As this securement screw 92 is already accurately aligned on the metal roof section 90 extending into the underlying roof frame beam 94, engagement of the securement screw 92 by the screw engagement slot 30 results in a precise proper alignment of the forward end 14 of longitudinally extended frame 12 on the metal roof section 90.

Mounted on rearward end 16 of longitudinally extended frame 12 is a rearward alignment structure 32 which, in the preferred embodiment, includes a pair of downwardly depending rear alignment bars 34*a* and 34*b* mounted on the outside of each of the frame plates 18*a* and 18*b* and extending downward below the base of the frame plates 18*a* and 18*b* approximately one to four inches. Due to the overall length of longitudinal frame 12, when the metal sheet punch device 10 is placed on the metal roof section 90 with the screw engagement slot 30 engaging securement screw 92, the rear alignment bars 34*a* and 34*b* are positioned outside of the edge of metal roof section 90 to depend downwards over the roof frame beam 94 on which the metal roof section 90 is to be mounted. Each of the rear alignment bars 34*a* and 34*b* are positioned on the opposite side of the roof frame beam 94 thus ensuring that the metal sheet punch device 10 is properly aligned on the metal roof section 90 such that the securement screw indentations formed by the metal sheet punch device 10 are aligned with the roof frame beam 94 on which the metal roof section 90 is positioned. The positioning of the metal sheet punch device 10 is thus correctly performed by merely aligning the forward alignment structure 22 with the securement screw 92 and the rearward alignment structure 32 with the roof frame beam 94, an operation which can be performed quickly and easily with a maximum degree of accuracy each and every time the metal sheet punch device 10 of the present invention is used.

The metal sheet punch device 10 of the present invention also may include forward and rearward frame support legs 36*a*, 36*b*, 38*a* and 38*b* mounted on and extending downwards from frame 12 which assist with the positioning and support of the frame 12 when placed on the metal roof section 90. The metal sheet punch device 10 of the present invention also may include a forward handle 40 and a carrying strap (not shown) to facilitate the lifting and placing of the metal sheet punch device 10 on the metal roof section 90.

While the positioning of the metal sheet punch device 10 of the present invention in the proper orientation is important, it would be of little effect if the formation of the securement screw indentations still need to be performed by hand. Therefore, the metal sheet punch device 10 of the present invention includes a plurality of metal punch devices 50*a–d* each of which are designed to mechanically create a securement screw indentation in the same manner each and every time to ensure accurate spacing and accurate placement of the securement screw indentations. As each of the metal punch devices 50*a–d* are generally identical to one another and are triggered in substantially the same manner, the following description of metal punch device 50*a* should be understood to apply equally to metal punch devices 50*b*, 50*c* and 50*d*.

Figure 5:
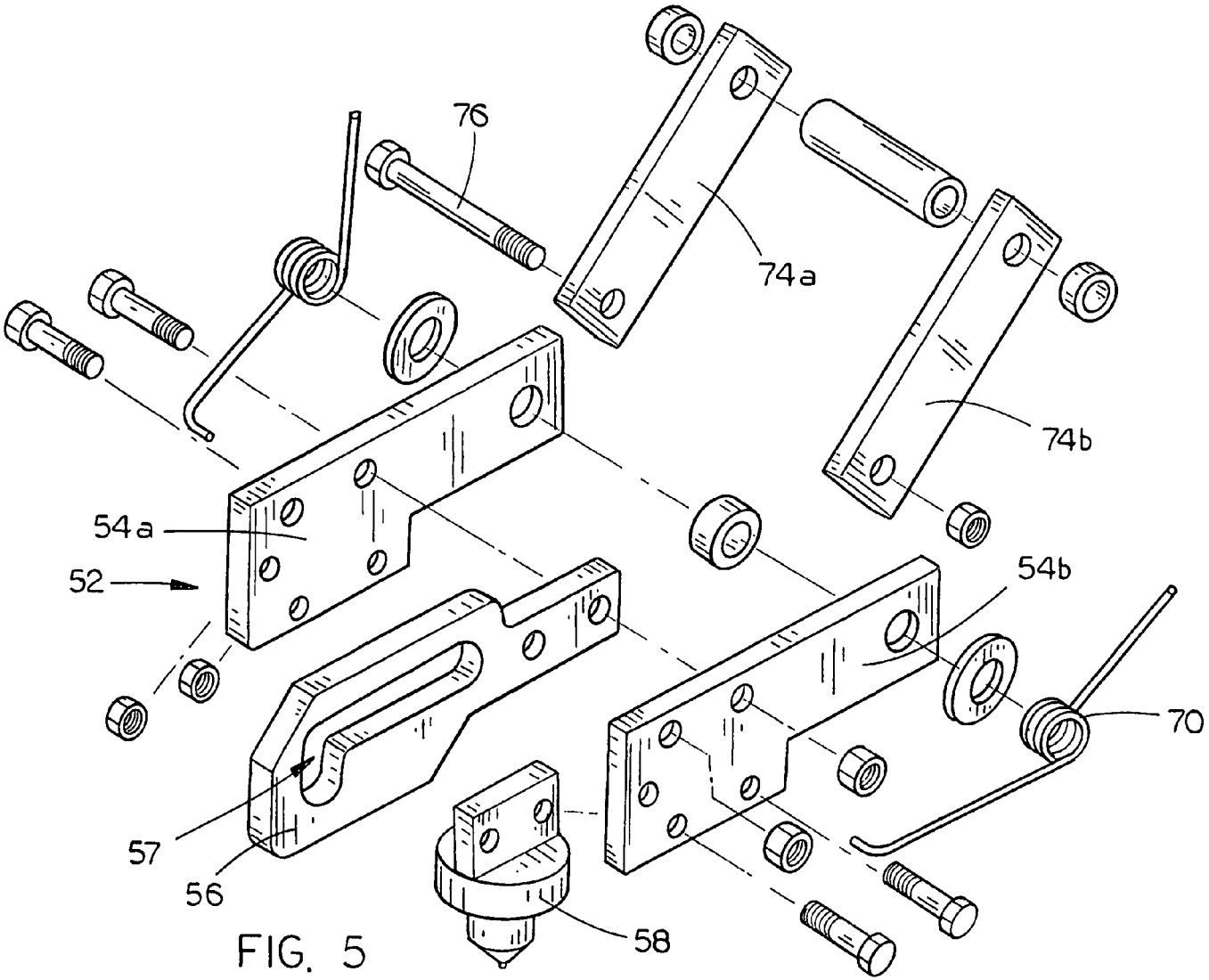
FIG. 5 is a detailed exploded perspective view of one metal punch device found in the present invention.
Figure 6:
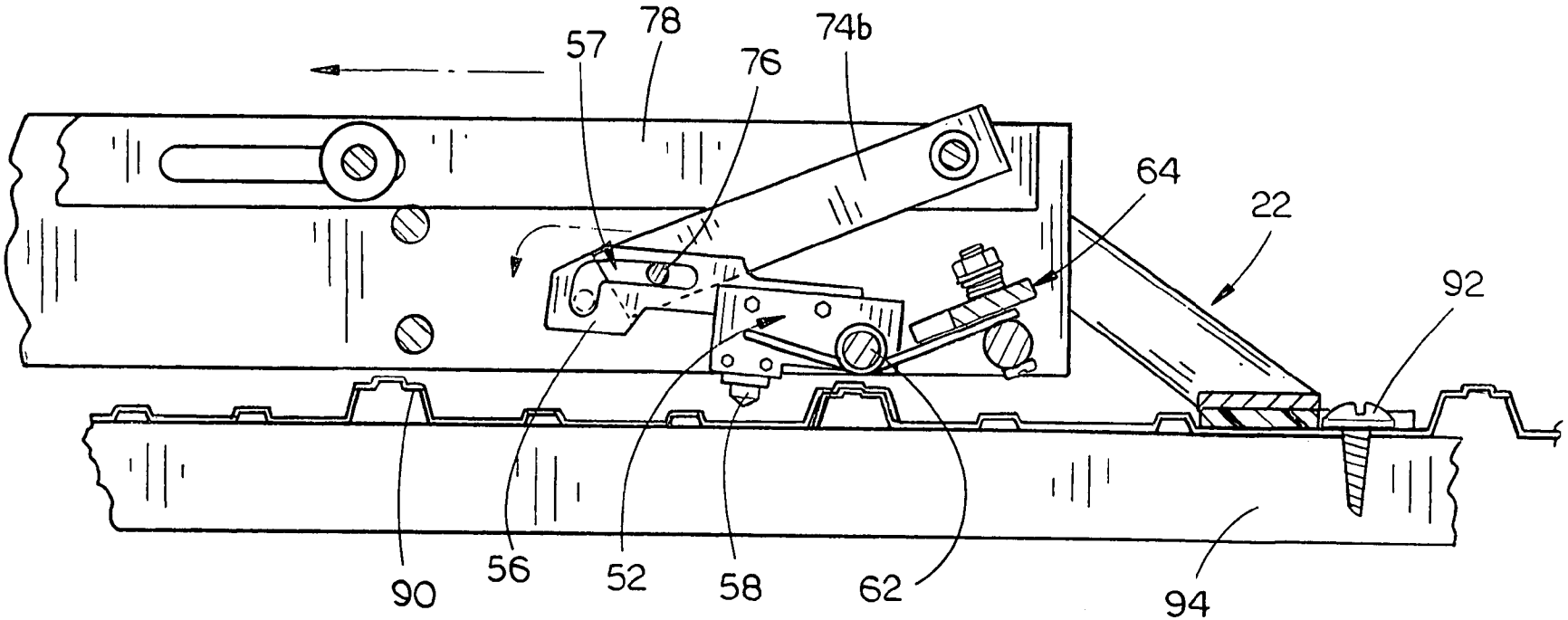
FIG. 6 is a detailed side elevational view of one metal punch device of the present invention showing the operation of the punch device.
Figure 7:
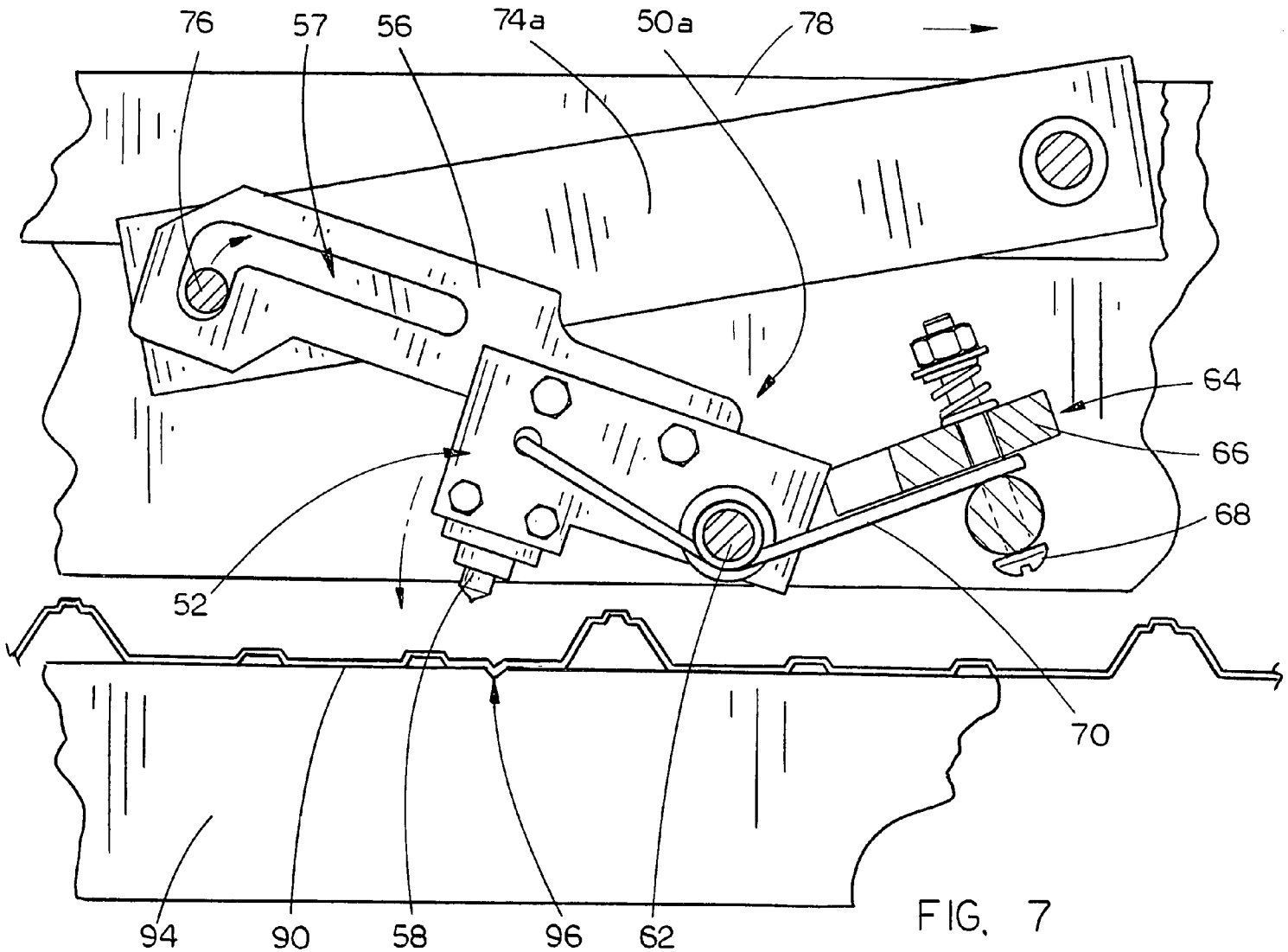
FIG. 7 is a detailed side elevational view of one metal punch device of the present invention showing the metal punch forming an indentation in the metal roof section.

Metal punch device 50*a* is shown best in FIGS. 5, 6 and 7 as including a metal punch support arm structure 52 which includes left and right punch support bars 54*a* and 54*b*, actuating arm 56 mounted on and extending forwards from punch support bars 54*a* and 54*b* and the metal punch 58 itself which is mounted on the punch support bars 54*a* and 54*b* and extends downwards therefrom. The punch support bars 54*a* and 54*b*, actuating arm 56 and metal punch 58 are secured to one another by a plurality of bolts 60 and the assembled metal punch support arm structure 52 is pivotally mounted on the longitudinally extended frame 12 via pivot bolt 62 which extends through the rearward ends of punch support bars 54*a* and 54*b* and through the frame plates 18*a* and 18*b*.

Mounted on and extending between the frame plates 18*a* and 18*b* rearward of the metal punch support arm structure 52 is a spring anchor 64 which would preferably consist of a plate 66 having a bolt 68 extending therethrough to secure the back end of the coiled spring 70 such that when metal punch support arm structure 52 is pivoted about pivot bolt 62, the tension in coiled spring 70 attempts to drive the metal punch support arm structure 52 downwards, or as is shown in FIG. 7, rotate the metal punch support arm structure 52 in a counterclockwise direction about pivot bolt 62 thus driving metal punch 58 downwards to contact the metal roof section 90 over which the metal sheet punch device 10 is positioned. Of course, it should be noted that the coiled spring 70 may be replaced by any appropriate drive device, such as a pneumatic or hydraulic piston or ram which would be connected to the metal punch support arm structure 52 in the appropriate manner to drive the metal punch support arm structure 52 downwards to drive metal punch 58 into the metal roof section 90 to create the securement screw indentation 96 shown best in FIG. 7. Such substitution of alternate drive devices would be understood by those skilled in the art of pneumatic and hydraulic systems.

The trigger mechanism for the metal punch support arm structure 52 is shown best in FIGS. 5, 6 and 7 as including a pair of downwardly and forwardly depending trigger bars 74*a* and 74*b* between which extends an actuating arm engagement bolt 76 which extends through the generally L-shaped slot 57 in actuating arm 56 as shown best in FIGS. 6 and 7. The upper ends of trigger bars 74*a* and 74*b* are connected to trigger actuating arm 78 which extends along the length of frame plates 18*a* and 18*b* as shown best in FIG. 6. The trigger actuating arm 78 is slidably mounted between frame plates 18*a* and 18*b* such that the trigger actuating arm 78 may be slid in a generally horizontal plane. The sliding or "cocking" of the trigger actuating arm 78 is performed by the rotation of trigger bar 80 which is rotatably mounted on the frame 12 as shown best in FIGS. 3 and 4. The metal punch device 50*a* would thus be triggered in the following manner.

Figure 8:
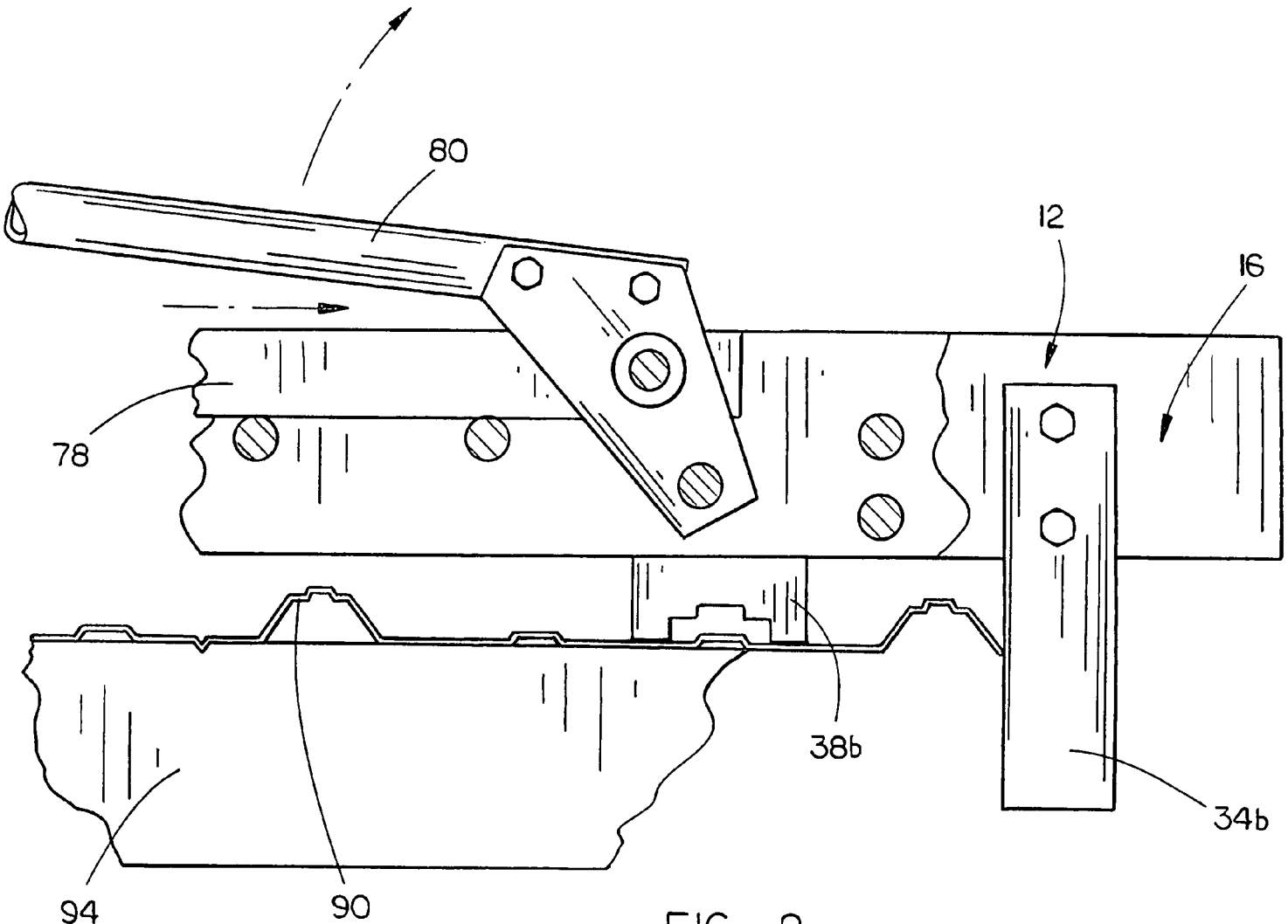
FIG. 8 is a detailed side elevational view of the rearward end of the longitudinally extended frame showing the trigger bar being raised to trigger the operation of the metal punch devices.

As trigger bar 80 is rotated upwards, trigger actuating arm 78 is slid rearwards towards the rearward end 16 of longitudinally extended frame 12 thus producing the movement shown best in FIGS. 6 and 8 of the drawings. The movement of the trigger actuating arm 78 moves trigger bars 74*a* and 74*b* rearwards permitting actuating arm bolt 76 housed within L-shaped slot 57 of actuating arm 56 to slide rearwards and fall into the lower section of the L-shaped slot 57 as shown in FIG. 6. As trigger bar 80 is returned to its position adjacent the frame 12, trigger actuating arm 78 is slid forwards and, as best shown in FIG. 7, the trigger bars 74*a* and 74*b* are slid forward also with actuating arm bolt 76 being temporarily caught within the lowermost portion of L-shaped slot 57 of actuating arm 56. This causes the metal punch support arm structure 52 to be pulled upwards and forwards in clockwise rotation about pivot bolt 62 (from the viewpoint of FIG. 7) thus tensioning coiled spring 70. As the sliding of trigger actuating arm 78 continues, the actuating arm bolt 76 eventually reaches a point within L-shaped slot 57 of actuating arm 56 where it no longer is frictionally retained within the lowermost portion of L-shaped slot 57 and the actuating bolt 76 slides forwards within L-shaped slot 57 releasing actuating arm 56 and thus metal punch support arm structure 52. The tension built up in coiled spring 70 thus is released driving the metal punch 58 downwards to impact the metal roof section 90 to create the securement screw indentation 96 as shown best in FIG. 7. As each of the metal punch devices 50*a–d* are generally identical and are generally identically connected to the trigger actuating arm 78 and trigger bar 80, each of the metal punch devices 50*a–d* are generally simultaneously triggered to create four identical securement screw indentations 96 which are spaced along the metal roof section 90 in the predetermined indentation locations. The metal sheet punch device 10 may then be moved to the next location, aligned and triggered to create the next set of securement screw indentations in the metal roof section 90. It is thus seen how quickly and easily a number of indentations is formed in the metal roof by use of the present invention, thus greatly increasing the efficiency of the user of the present invention and reducing mistakes and risks associated with those devices and systems found in the prior art for performing the indentation forming task.

For facilitating carrying of the metal sheet punch device 10 of the present invention, a carrying strap 82 may be attached to one or more of the spacer rods 20 as shown in FIGS. 1 and 2. The carrying strap 82 is preferably constructed of nylon or another such durable material and is used in conjunction with the trigger bar 80 to lift and carry the metal sheet punch device 10 between use locations.

It is to be understood that numerous modifications, additions and substitutions may be made to the present invention which fall within the intended broad scope of the appended claims. For example, the size, shape and construction materials used in connection with the metal sheet punch device 10 of the present invention may be modified or changed so long as the intended functionality of the invention is maintained. Likewise, the precise nature of the support arm structure drive device may be modified or changed to incorporate not only a coiled spring but other types of drive devices such as pneumatic or hydraulic pistons, any of which would be understood by those skilled in the art of such systems. Furthermore, the precise nature of the triggering device and precise arrangement of the metal punch devices may be modified or changed so long as the intended functional features of creating a plurality of securement screw indentations in a metal roof section in a general simultaneous manner is preformed. Finally, although the present invention has been described for use in connection with corrugated metal roofs, it may be adapted for use in virtually any situation where a plurality of spaced indentations are to be formed to permit the insertion of fastening devices therein.

There has therefore been shown and described a metal sheet punch device 10 which accomplishes at least all of its intended objectives.

We claim:

1. A metal sheet punch device for use with metal sheeting for roofs, ceilings and walls comprising:

a longitudinally extended frame having forward and rearward ends;

alignment means mounted on said frame adjacent said forward and rearward ends for aligning said frame on a metal sheet;

at least two metal punch devices mounted on said frame, each of said metal punch devices including;

a metal punch support structure movably mounted on said frame, said metal punch support structure movable between a retracted position and an extended position relative to said frame;

a metal punch having a pointed lower end, said metal punch mounted on the underside of said metal punch support structure;

support structure drive means mounted on said frame and operatively connected to said metal punch support structure to move said metal punch support structure between said retracted position and said extended position; and trigger means operatively connected to said at least two metal punch devices, said trigger means operative to trigger said support structure drive means to drive each of said metal punch support structures from said retracted position to said extended position such that said metal punches each engage a metal sheet on which said metal sheet punch device is positioned and form at least two indentations in the metal sheet by impact of said metal punches with the metal sheet.

2. The metal sheet punch device of claim 1 wherein said longitudinally extended frame comprises a pair of generally parallel frame plates spaced from one another and supported apart from and connected to one another by a plurality of spacer rods.

3. The metal sheet punch device of claim 1 wherein said alignment means mounted on said frame adjacent said forward end comprises at least one mounting arm extending forwards and downwards from said frame, an alignment plate mounting bar mounted on the forward end of said at least one mounting arm and an alignment plate mounted on said alignment plate mounting bar including a screw engagement slot formed in the forward end of said alignment plate, said screw engagement slot operative to fit over and engage a securement screw which has already been mounted in the metal sheet thereby aligning the forward end of said frame with an already positioned securement screw.

4. The metal sheet punch device of claim 1 wherein said alignment means mounted on said frame adjacent said rearward end comprises a pair of downwardly depending rear alignment bars mounted on opposite sides of said frame and extending downward below the base of said frame such that when said frame is placed on a metal sheet, said rear alignment bars are positioned outside of the edge of the metal sheet to depend downwards over the underlying roof frame beam on which the metal sheet is to be mounted, thereby aligning the rearward end of said frame with the underlying roof frame beam.

5. The metal sheet punch device of claim 1 wherein said metal punch support structure of each of said at least two metal punch devices comprises at least one punch support bar having a rearward end pivotably mounted on said frame, said metal punch mounted on a forward end of said at least one punch support bar.

6. The metal sheet punch device of claim 1 wherein said support structure drive means of each of said at least two metal punch devices comprises a spring.

7. The metal sheet punch device of claim 1 wherein said support structure drive means of each of said at least two metal punch devices comprises a pneumatic piston.

8. The metal sheet punch device of claim 1 wherein said support structure drive means of each of said at least two metal punch devices comprises an hydraulic ram.

9. The metal sheet punch device of claim 1 wherein each of said at least two metal punch devices further comprise an actuating arm mounted on and extending outwards from said metal punch support structure, said actuating arm including an L-shaped slot formed therein.

10. The metal sheet punch device of claim 9 wherein said trigger means comprises a trigger actuating arm movably mounted on said frame, a trigger bar rotatably mounted on said frame and operatively connected to said trigger actuating arm and an actuating arm bolt housed within said L-shaped slot of said actuating arm, said actuating arm bolt operative slide within said L-shaped slot and alternatively frictionally and mechanically engage and release to trigger said support structure drive means to drive said metal punch support structure from said retracted position to said extended position to impact a metal sheet section to create a securement screw indentation.

11. The metal sheet punch device of claim 1 wherein said trigger means is operative to generally simultaneously trigger each of said at least two metal punch devices.

12. A metal sheet punch device for use with metal sheeting for roofs, ceilings and walls comprising:

a longitudinally extended frame having forward and rearward ends;

forward and rearward alignment means mounted on said frame adjacent said forward and rearward ends for aligning said frame on a metal sheet;

at least two metal punch devices mounted on said frame, each of said metal punch devices including;

a metal punch support structure movably mounted on said frame, said metal punch support structure movable between a retracted position and an extended position relative to said frame;

a metal punch having a pointed lower end, said metal punch mounted on the underside of said metal punch support structure;

spring means mounted on said frame and connected to said metal punch support structure to rapidly and forcefully move said metal punch support structure between said retracted position and said extended position; and trigger means operatively connected to said at least two metal punch devices, said trigger means operative to trigger said spring means to drive each of said metal punch support structures from said retracted position to said extended position such that said metal punches each engage a metal sheet on which said metal sheet punch device is positioned and form at least two indentations in the metal sheet by impact of said metal punches with the metal sheet.

13. The metal sheet punch device of claim 12 wherein said longitudinally extended frame comprises a pair of generally parallel frame plates spaced from one another and supported apart from and connected to one another by a plurality of spacer rods.

14. The metal sheet punch device of claim 12 wherein said alignment means mounted on said frame adjacent said forward end comprises at least one mounting arm extending forwards and downwards from said frame, an alignment plate mounting bar mounted on the forward end of said at least one mounting arm and an alignment plate mounted on said alignment plate mounting bar including a screw engagement slot formed in the forward end of said alignment plate, said screw engagement slot operative to fit over and engage a securement screw which has already been mounted in the metal sheet thereby aligning the forward end of said frame with an already positioned securement screw.

15. The metal sheet punch device of claim 12 wherein said alignment means mounted on said frame adjacent said rearward end comprises a pair of downwardly depending rear alignment bars mounted on opposite sides of said frame and extending downward below the base of said frame such that when said frame is placed on a metal sheet, said rear alignment bars are positioned outside of the edge of the metal sheet to depend downwards over the underlying roof frame beam on which the metal sheet is to be mounted, thereby aligning the rearward end of said frame with the underlying roof frame beam.

16. The metal sheet punch device of claim 12 wherein said metal punch support structure of each of said at least two metal punch devices comprises at least one punch support bar having a rearward end pivotably mounted on said frame, said metal punch mounted on a forward end of said at least one punch support bar.

17. The metal sheet punch device of claim 12 wherein each of said at least two metal punch devices further comprise an actuating arm mounted on and extending outwards from said metal punch support structure, said actuating arm including an L-shaped slot formed therein.

18. The metal sheet punch device of claim 17 wherein said trigger means comprises a trigger actuating arm movably mounted on said frame, a trigger bar rotatably mounted on said frame and operatively connected to said trigger actuating arm and an actuating arm bolt housed within said L-shaped slot of said actuating arm, said actuating arm bolt operative slide within said L-shaped slot and alternatively frictionally and mechanically engage and release to trigger said support structure drive means to drive said metal punch support structure from said retracted position to said extended position to impact a metal sheet section to create a securement screw indentation.

19. The metal sheet punch device of claim 12 wherein said trigger means is operative to generally simultaneously trigger each of said at least two metal punch devices.

* * * * *